US005695721A

United States Patent [19]

Kitagawa et al.

[11] Patent Number: 5,695,721

[45] Date of Patent: Dec. 9, 1997

[54] SPECIMEN STIRRING DEVICE AND SPECIMEN SAMPLING APPARATUS

[75] Inventors: Nobuhiro Kitagawa; Masakazu Fukuda, both of Kobe, Japan

[73] Assignee: Toa Medical Electronics Co., Ltd., Hyogo, Japan

[21] Appl. No.: 549,215

[22] Filed: Oct. 27, 1995

[30] Foreign Application Priority Data

Oct. 27, 1994 [JP] Japan ..... 6-263973

[51] Int. Cl.[6] ..... B01F 7/22

[52] U.S. Cl. ..... 422/99; 422/100; 422/224; 422/225; 422/63; 436/180

[58] Field of Search ..... 422/63, 67, 75, 422/99, 100, 101, 224, 225; 436/47, 174, 180

[56] References Cited

U.S. PATENT DOCUMENTS

| | | | |
|---|---|---|---|
| 2,015,244 | 9/1935 | Stockdale | 422/225 |
| 2,888,322 | 5/1959 | Podschus et al. | 422/225 X |
| 2,943,062 | 6/1960 | Mader | 422/225 X |
| 3,174,829 | 3/1965 | Stokstad | 422/75 |
| 3,900,291 | 8/1975 | Francardi | 422/75 |
| 4,318,402 | 3/1982 | Vaillancourt | 128/214.4 |
| 4,948,563 | 8/1990 | Kanewske | 422/99 |
| 5,084,241 | 1/1992 | Parker | 422/100 |
| 5,334,359 | 8/1994 | Masutomi et al. | 422/225 |

FOREIGN PATENT DOCUMENTS

| | | |
|---|---|---|
| 0527059 | 2/1993 | European Pat. Off. . |
| 54-134690 | 10/1979 | Japan . |
| 62-69162 | 4/1987 | Japan . |
| 5-40123 | 2/1993 | Japan . |

*Primary Examiner*—Harold Pyon

[57] ABSTRACT

A specimen stirring device has a stirring impeller on a rotating shaft enclosed in a pipe having one or more side holes in a central portion thereof and a nozzle portion at its end and by rotation of the stirring impeller can create a circulating flow of specimen liquid flowing out of the pipe through the nozzle portion, upward along the outside of the pipe and back into the pipe through the side holes and thereby efficiently stir a specimen liquid in a specimen container even if the specimen container is long and slender or has a tapered bottom and without there being a possibility of the stirring impeller and the specimen container making contact with and damaging each other. A specimen sampling apparatus including this specimen stirring device is also disclosed.

11 Claims, 7 Drawing Sheets

SPECIMEN STIRRING DEVICE AND SPECIMEN SAMPLING APPARATUS

BACKGROUND OF THE INVENTION

This invention relates to a specimen stirring device and a specimen sampling apparatus, and more particularly to a specimen stirring device for, when components of a specimen liquid such as urine or the like in a urine test tube are to be analyzed with an analyzing apparatus, stirring the specimen liquid in the urine test tube and thereby uniformly dispersing the components, for example settled components, in the specimen, and a specimen sampling apparatus including this specimen stirring device.

Known methods of stirring a specimen liquid when suspended components which have settled at the bottom of a urine test tube or the like are to be dispersed by stirring with a stirring device and a homogeneous specimen liquid is to be delivered as a test sample to an analyzing apparatus include (1) inverting the container and (2) inserting a stirring device such as a stirring rod or a stirring impeller into the specimen container and rotating this or moving it up and down (an example wherein a liquid in a specimen container is stirred using a stirring impeller 21 is shown in FIG. 8).

However, in the case of method (1) it is necessary to seal the container, and it is not possible to use this method with a container having no lid. In the case of method (2), because in a long and slender container dispersion of the specimen by stirring is carried out locally, a long time is required to make the whole specimen liquid homogeneous. Also, it sometimes happens that the stirring device such as the stirring impeller 21 and the specimen container come into contact with and damage each other, and if an attempt is made to prevent this by keeping the two well apart the movement of the stirring device is limited and adequate stirring is not possible. In particular, with the container for urine testing shown in FIG. 8, because the bottom of the container is tapered it is not possible to insert the stirring device fully as far as the bottom of the container. As a result, it is difficult to disperse settled specimen components uniformly throughout the specimen liquid.

In Japanese Laid-Open Patent Publication No. H.5-40123, a stirring device which performs specimen suction and specimen discharge at different locations is disclosed. According to this disclosure, even if a specimen liquid is in a container for urine testing having a tapered bottom, or even if there is a large quantity of specimen liquid, stirring can be performed without creating bubbles. However, with this device, to make the specimen liquid homogeneous, suction and discharge have to be performed several times.

SUMMARY OF THE INVENTION

An object of this invention is to provide a specimen stirring device which can efficiently stir a specimen liquid in a specimen container even if the specimen container is long and slender or has a tapered bottom and with which a stirring impeller and the specimen container do not make contact with and damage each other, and a specimen sampling apparatus including this specimen stirring device.

This invention provides a specimen stirring device comprising a hollow pipe having one or more side holes in a central portion thereof and a stirring impeller having a rotating shaft disposed inside the pipe, wherein one of the end of the pipe and the one or more side holes are made an outflow opening and the other is made an inflow opening and when the pipe containing the stirring impeller is inserted the end of the pipe into a specimen container containing a specimen liquid and the rotating shaft is driven a specimen liquid circulating flow of specimen liquid circulating through the outflow opening to outside the pipe and through the inflow opening back into the pipe is created.

The invention also provides a specimen sampling apparatus comprising the specimen stirring device described above, raising and lowering means for supporting and raising and lowering the specimen stirring device, specimen container moving means for moving a specimen container in cooperation with the raising and lowering means, and a specimen suction part for sucking a specimen liquid from inside a specimen container stirred by the specimen stirring device.

A specimen stirring device according to the invention is used to stir specimen liquid inside a specimen container, and is particularly suitable for application to a specimen container which is a cylindrical vessel with a tapered or rounded bottom like a urine test tube. Accordingly, the hollow pipe in this invention does not have to be a pipe whose internal diameters and external diameters are equal at both ends and may be a pipe whose internal diameter and/or external diameter change, but the external diameter is set so that the pipe can be inserted into the specimen container and a specimen liquid flow passage can be formed between the inner wall of the specimen container and the pipe. For example, when stirring is to be carried out in a urine test tube of internal diameter about 15 mm, it is preferable that the external diameter of the pipe be about 8 mm. The material of which the pipe is made may be a metal resistant to corrosion by the object specimen liquid, for example stainless steel, or a synthetic resin or glass or the like.

The one or more side holes in this invention may for example be round holes or long holes. The position of any of the holes is set by its relation to the surface of the specimen liquid in the specimen container. When a plurality of side holes are provided arrayed in the circumferential direction the positions of the lower ends of the side holes do not have to be the same.

The stirring impeller having a rotating shaft in this invention is disposed inside the pipe and has the function of a pump for providing a stirring current necessary to stir the specimen liquid, and like the hollow pipe discussed above the stirring impeller should be made of a material having a resistance to corrosion by the object specimen liquid. The base of the rotating shaft should have a rotary drive source such as a motor or be connectable to a rotary drive source. The length of the shaft can be set by its relation to the length of the pipe, and may be made variable. The stirring impeller is fixed to the end of the rotating shaft and creates an axial flow in the rotating shaft direction when the rotating shaft is rotated. If the stirring impeller is propeller-like, there is no particular limit on the number of blades thereof, but for example there may be 2, 3, 4, 5, 6, 7 or 8 blades. There are no particular limits on the shape of the stirring impeller, but for example a helical impeller consisting of a single strip, a plurality of strips or a half strip may be used.

The stirring impeller in this invention preferably is positioned between the one or more side holes and the end of the pipe. If the stirring impeller is a helical impeller consisting of a plurality of strips, there is no particular limit on the relative position of the impeller and the one or more side holes.

In this invention, the end of the pipe preferably has a nozzle portion. Nozzle portion refers to a portion provided at the end of the pipe which creates a jet by constricting the specimen liquid outflow opening, and includes diffuser shaped and partition plate shaped nozzle portions. Here a diffuser shaped nozzle portion means a passage with a continuously decreasing area and a partition shaped nozzle portion means a passage whose area is reduced stepwise by a partition plate. In the case of a tapered specimen container, it is particularly preferable that a nozzle portion be formed at the end of the pipe and that this be made a specimen liquid outflow opening. Even when a pipe having no nozzle portion is used, a jet flow can be created by bringing the end of the pipe close to the bottom surface of the specimen container or making the diameter of the pipe small.

In this invention it is preferable that the nozzle portion be tapered. Specimen liquid discharged as a jet from the nozzle portion at the end of the pipe toward the bottom of the specimen container creates a specimen liquid circulating flow back into the pipe through the side holes. When the end of the pipe is made an inflow opening, a specimen liquid circulating flow in the opposite direction to that mentioned above can be created. Whether the nozzle portion is disposed so that it is convergingly tapered or divergingly tapered, i.e. the orientation of the diffuser, may be determined freely depending on the shape of the specimen container and the nature and properties of the specimen liquid.

In this invention, it is preferable that the blades of the stirring impeller be so disposed that when the rotating shaft is rotated the nozzle portion becomes an outflow opening and the side holes become inflow openings.

The raising and lowering means in this invention have suspended therefrom the stirring impeller having the rotating shaft and the pipe inside which the stirring impeller is disposed, and reciprocatingly moves this stirring device at least between a stirring position in the specimen container and a withdrawn position.

The specimen container moving means in this invention are horizontal moving means for moving the stirring device comprising the suspended stirring impeller having the rotating shaft and the pipe with respect to a line or a plurality of lines of specimen containers containing specimen liquid.

In a specimen stirring device according to the invention, when the pipe and the stirring impeller are inserted into a specimen container containing a specimen liquid and the rotating shaft is rotated, the stirring impeller creates a specimen liquid circulating flow of specimen liquid flowing out through the outflow opening, along the outside of the pipe and back into the pipe through the inflow opening. The specimen liquid circulating flow stirs the specimen liquid efficiently irrespective of the shape of the inside of the specimen container. Also, because sediment tending to settle at the bottom of the specimen container is picked up by the specimen liquid circulating flow and dispersed throughout the container, uniform stirring is possible. Also, because the pipe is interposed between the stirring impeller and the specimen container, the stirring impeller and the specimen container never come into contact with each other.

In a specimen sampling apparatus according to the invention, the stirring device and the pipe enclosing the stirring impeller having the rotating shaft are inserted into the specimen container containing the specimen liquid by the raising and lowering means. When the rotating shaft is rotated in the stirring position, the stirring impeller creates a specimen liquid circulating flow of specimen liquid flowing out through the outflow opening, along the outside of the pipe and back into the pipe through the inflow opening. As a result, stirring of the specimen liquid in the specimen container is carried out efficiently, and a uniformly stirred specimen liquid can be sent to a measuring apparatus or an analyzing apparatus by the specimen sampling part. Therefore, it is possible to carry out highly accurate measurement or analysis. After stirring, the stirring device and the pipe are removed from the specimen container by the raising and lowering means. Then, the stirring device and the pipe are positioned above the next specimen container by the specimen container moving means. The raising and lowering means then operates again and the stirring operation described above is repeated.

In this invention it is preferable that the end of the pipe have a nozzle portion because it is then possible to create a jet irrespective of the internal diameter and shape of the specimen container; however, even if there is no nozzle portion at the end of the pipe, it is possible to create a jet by making the diameter of the pipe small or adjusting the gap between the bottom of the specimen container and the end of the pipe.

In this invention, if the nozzle portion is tapered, because specimen liquid is discharged from the nozzle portion toward the bottom of the specimen container as a jet, sediment can be easily flushed up along the outside of the pipe and carried in the specimen liquid circulating flow. This is effective when particles of sediment are relatively large or are of large specific gravity. Also, if the nozzle portion is tapered it can be easily inserted into a specimen container as far as the bottom of the container.

With this invention, even when the specimen container containing the specimen liquid is a urine test tube having an open top and a tapered bottom, by inserting the tapered nozzle portion into the tapered urine test tube and rotating the rotating shaft it is possible to pick up and carry specimen components settled at the bottom of the urine test tube with a specimen liquid circulating flow and thereby uniformly stir the specimen liquid.

DETAILED DESCRIPTION OF THE PREFERRED EMBODIMENTS

Figure 1:
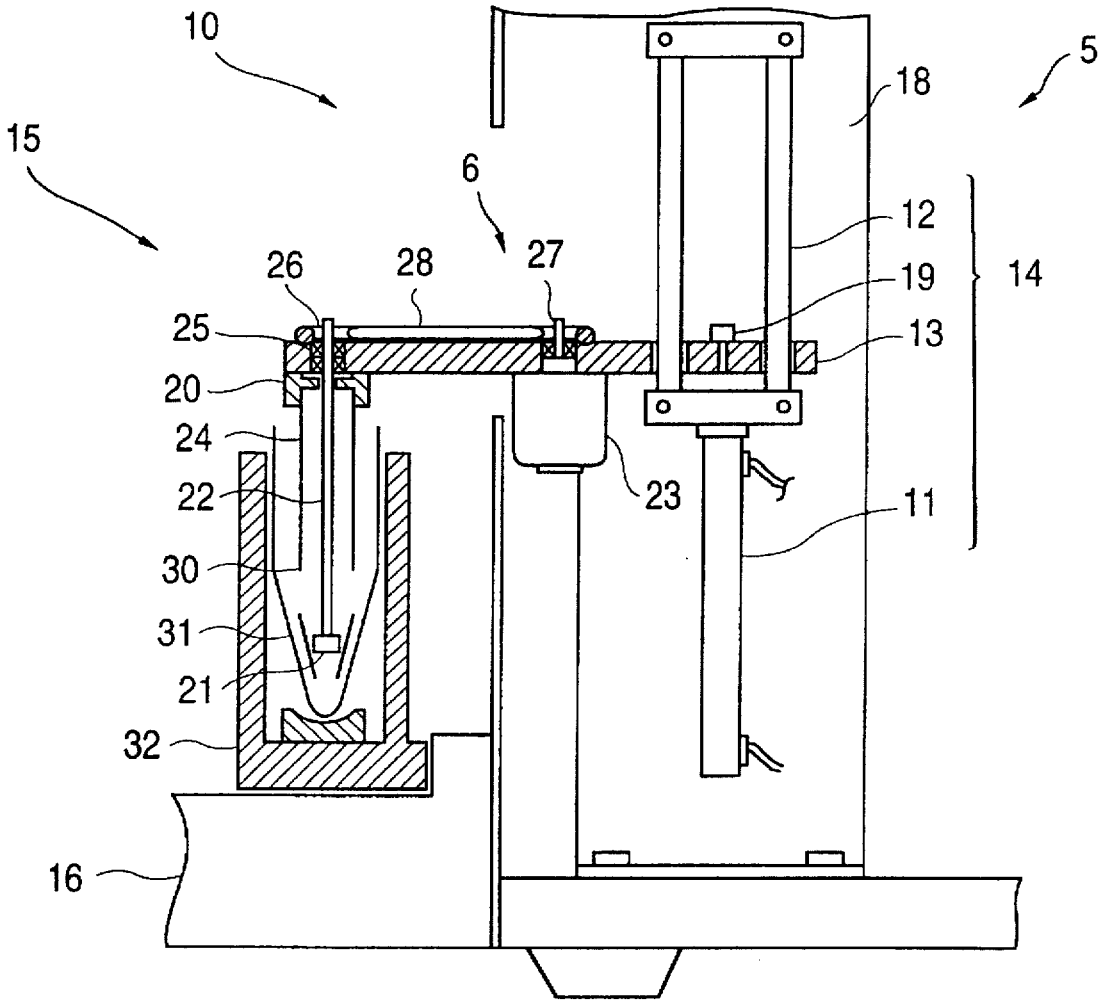
FIG. 1 is a side view of a specimen sampling apparatus according to a preferred embodiment of the invention.
Figure 2:
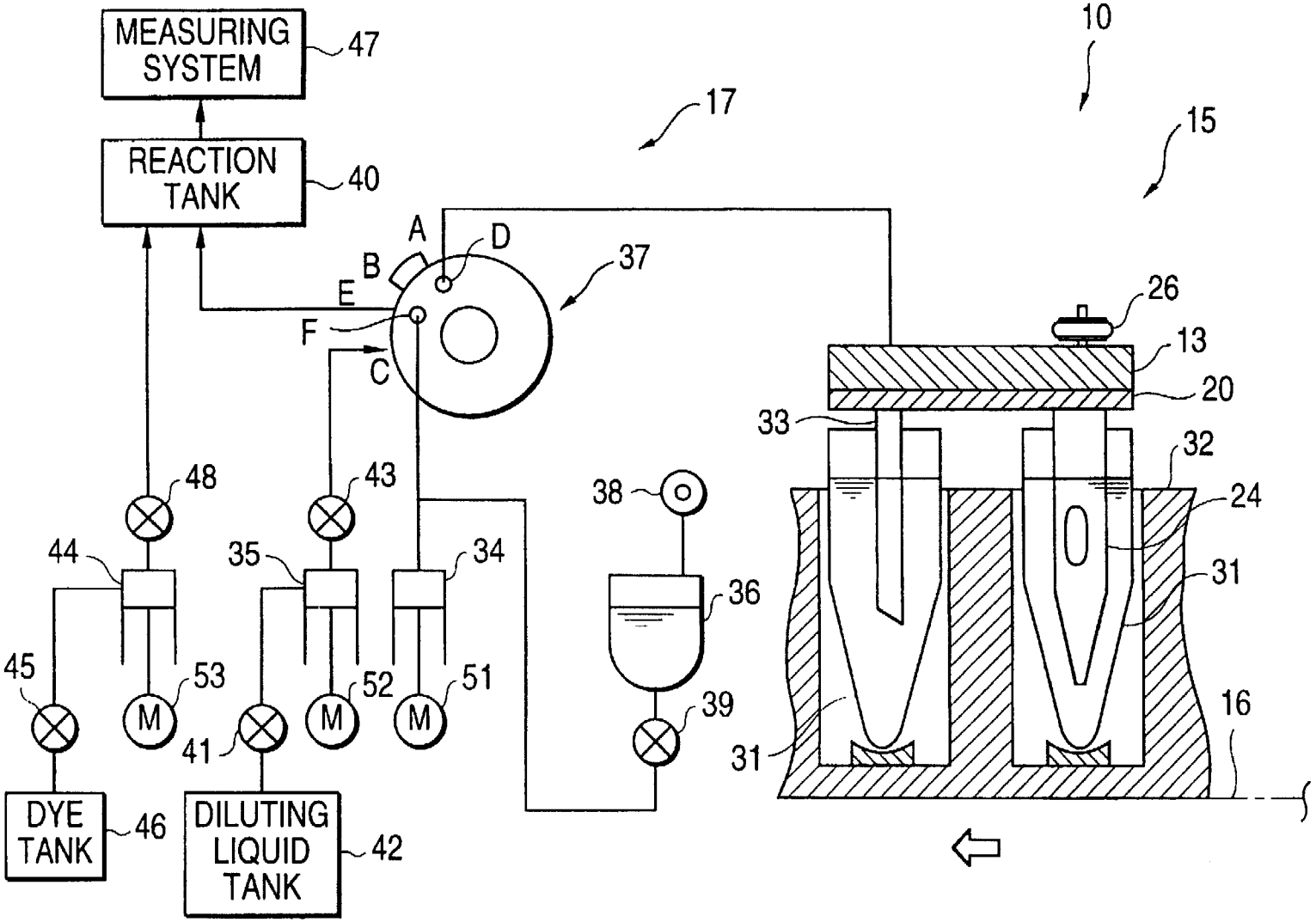
FIG. 2 is a front view of the specimen sampling apparatus of FIG. 1.

The basic construction of a specimen sampling apparatus comprising a specimen stirring device according to a preferred embodiment of the invention will now be described with reference to the side view of FIG. 1 and the front view of FIG. 2.

A specimen sampling apparatus 10 is mainly made up of raising and lowering means 14 comprising an air cylinder 11, a linear guide 12 and an arm 15, a specimen stirring part 15 mounted on the arm 13, a sampler 16 serving as specimen container moving means, and a specimen suction part 17.

The air cylinder 11 is connected to a driving source not shown in the drawings. The linear guide 12 is mounted on the specimen sampling apparatus 10 proper by way of a mounting plate 18. The end of a rod 19 of this air cylinder 11 is fixed to the rear end of the arm 13. The linear guide 12 supports the arm 13 in two places slidably in the vertical direction. One end of a holder 20 holds a pipe 24 which is part of the specimen stirring part 15, which will be further discussed later, and the other end holds a suction nozzle 33 which is part of the specimen suction part 17.

The specimen stirring part 15 is mainly made up of a rotating shaft 22 having a stirring impeller 21 provided on the lower end thereof, a motor 23 for rotationally driving the rotating shaft 22, and the pipe 24 which surrounds the stirring impeller 21. The upper part of the rotating shaft 22 is rotatably mounted on the arm 13 by way of a bearing 25, and a pulley 26 is mounted on the upper end of the rotating shaft 22.

The motor 23 is mounted on a middle portion of the arm 13 and has a pulley 27 mounted on its rotating shaft. A belt 28 runs around the pulleys 26 and 27, and as a result rotation of the motor 23 is transmitted to the rotating shaft 22 by way of the pulley 27, the belt 28 and the pulley 26.

Figure 3:
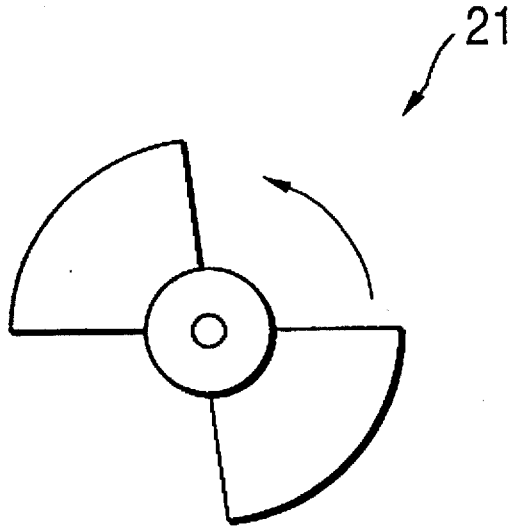
FIG. 3 is a plan view of a stirring impeller of FIG. 1.
Figure 4:
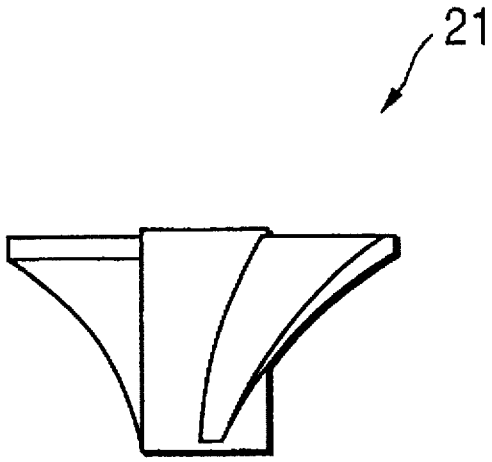
FIG. 4 is a front view of the stirring impeller of FIG. 3.

As shown in FIG. 3 and FIG. 4, the stirring impeller 21 is a propeller having two blades having a predetermined angle of twist. In this specimen stirring part 15 the stirring impeller 21 rotates so that it creates a downward axial flow.

Figure 5:
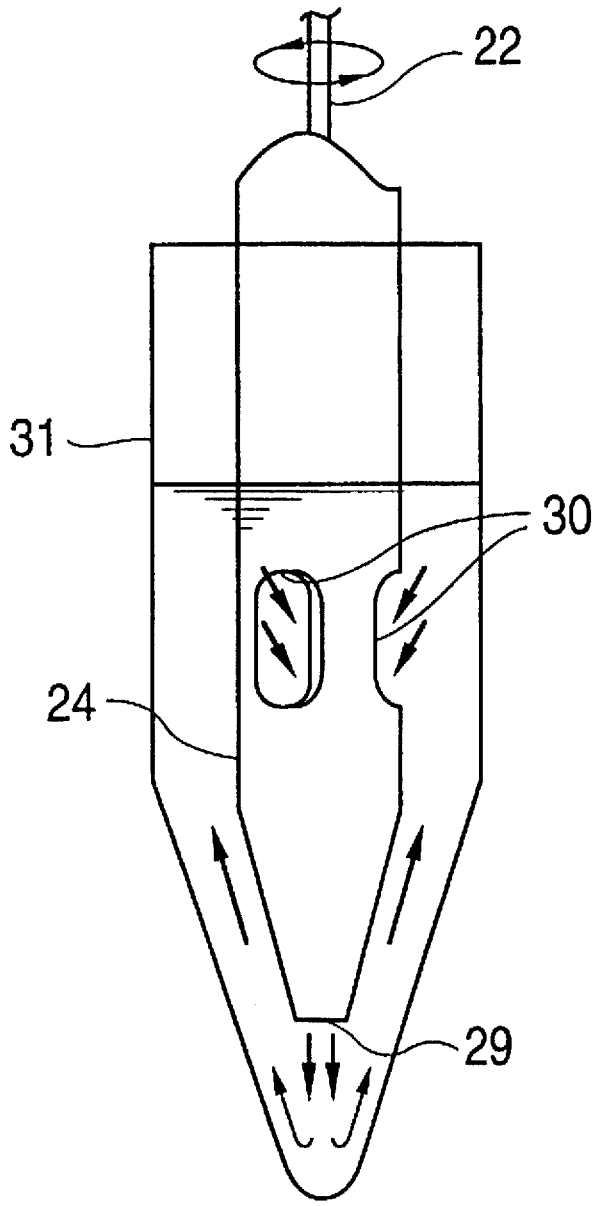
FIG. 5 is a view illustrating the operation of a specimen stirring device inserted into a test tube.
Figure 6:
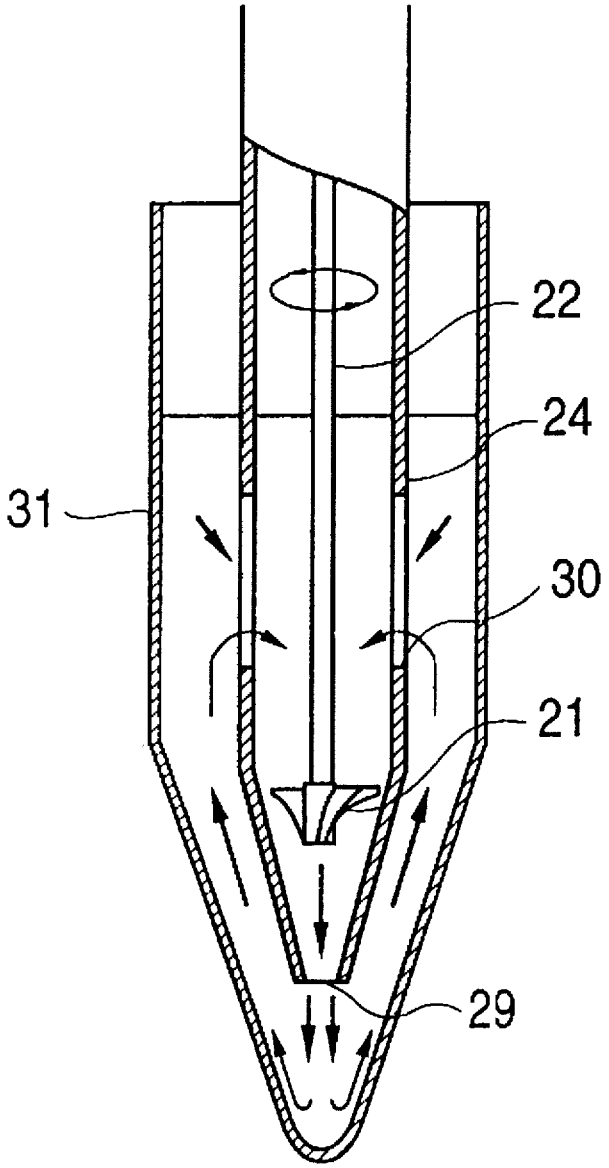
FIG. 6 is a sectional view of the specimen stirring device of FIG. 5.

The pipe 24 is mounted on the holder 20 substantially concentrically with the rotating shaft 22. As shown in FIG. 5 and FIG. 6, a tapered nozzle portion 29 serving as an outflow opening is formed at the lower end of the pipe 24. A plurality of side holes 30 serving as inflow openings are formed in a middle portion of the pipe 24 substantially uniformly spaced in the circumferential direction. The side holes 30 are long holes having long axes in the axial direction of the pipe 24. When the internal diameter of a urine test tube 31, serving as a specimen container, is 15 mm it is preferable that the external diameter of the pipe 24 be 8 mm and that the diameter of the opening of the nozzle portion 29 be 4 mm. The height of the side holes 30 is so set that at least parts of them are positioned below the surface of the liquid in the test tube 31.

A rack 32 holding a plurality of test tubes 31 is disposed below the holder 20. The rack 32 is placed on the sampler 16 which is movable intermittently in the direction of the arrow in FIG. 2 in cooperation with the raising and lowering means 14.

The specimen suction part 17 is mainly made up of the suction nozzle 33 mounted on one end of the holder 20, a specimen supply syringe 34, a diluting liquid supply syringe 35, a cleaning liquid tank 36 and a sampling valve 37 for switching flow paths. The suction nozzle 33 is mounted substantially in parallel with the pipe 24 mounted on the other end of the holder 20. The spacing between the suction nozzle 33 and the pipe 24 is equal to the spacing between the holding parts of the rack 32 which hold the test tubes 31.

A base opening of the suction nozzle 33 is connected by a pipe to a fixed port A of the sampling valve 37, a fixed port E of the sampling valve 37 is connected to a reaction tank 40 and a fixed port C of the sampling valve 37 is connected to the diluting liquid supply syringe 35 by way of a valve 43. A movable port D of the sampling valve 37 is connected to the suction nozzle 33. A movable port F of the sampling valve 37 is connected by pipes to the specimen supply syringe 34 and the cleaning liquid tank 36. A valve 39 is disposed between the cleaning liquid tank 36 and the sampling valve 37, and the diluting liquid supply syringe 35 is connected to a diluting liquid tank 42 by way of a valve 41. With this construction, by opening and closing of the valves 39, 41 and 43 and switching of the sampling valve 37 it is possible for specimen liquid in the test tube 31 to be fed to the reaction tank 40, for specimen liquid fed into the reaction tank 40 to be diluted with diluting liquid and for the pipes to be cleaned with cleaning liquid.

A dye supply syringe 44 for introducing dye into the reaction tank 40 is connected to the reaction tank 40 by way of a valve 48. A dye tank 46 is connected to the dye supply syringe 44 by way of a valve 45. Also, a measuring system 47 for measuring a urine test substance produced by the reaction tank 40 is connected to this specimen sampling apparatus 10. Motors 51, 52 and 53 are connected to the syringes 34, 35 and 44, respectively, and drive suction and discharging operations thereof. The motors 51, 52 and 53 are combined with ball screws and nuts and can feed fixed quantities of liquids by means of the syringes 34, 35 and 44.

Next, the operation of the specimen sampling apparatus 10 will be described. The following operation is carried out based on instructions from a control part not shown in the drawings. When the specimen sampling apparatus 10 is started up by an operator, the raising and lowering means 14 operates and lowers the arm 13 to a predetermined position with respect to a test tube 31 previously placed in the rack 32. When the end of the nozzle portion 29 of the pipe 24 has moved to a position about 10 mm from the bottom of the test tube 31, the operation of the raising and lowering means 14 is stopped. At this time, it is preferable that the centers of the side holes 30 be positioned about 15 mm below the surface of the liquid in the test tube 31.

When the motor 23 is then operated, the rotation of the motor is transmitted to the stirring impeller 21 and the stirring impeller 21 rotates at a speed in the vicinity of 2200 rpm. Consequently, inside the pipe 24 an axial flow toward the end of the nozzle portion 29 is created and outside the pipe 24 a reflux toward the side holes 30 is created. As a result, specimen liquid is discharged as a jet from the nozzle portion 29 and a circulating flow of specimen liquid circulating up the outside of the pipe 24, through the side holes 30 and down the inside of the pipe 24 is created. By the circulating flow of specimen liquid thus created, stirring of the specimen liquid in the test tube 31 is effected.

Figure 8:
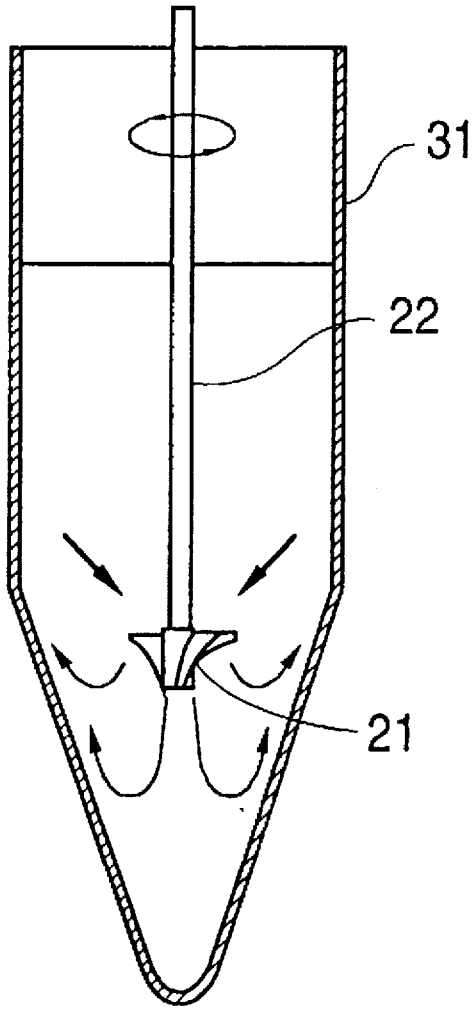
FIG. 8 is a view illustrating a conventional specimen stirring device and the operation thereof.

The tapered nozzle portion 29 is provided at the end of the pipe 24 in order to increase the speed at which the specimen liquid is discharged from the pipe 24. In this way, it is possible to flush sediment at the bottom of the test tube 31 up the outside of the pipe 24. Some of the flushed sediment is carried up to the side holes 30 in the specimen liquid circulating flow and circulates down the inside of the pipe 24. Therefore, compared to a conventional stirring device, that is, a stirring device, as shown in FIG. 8, a rotating shaft having a stirring impeller 21 is rotated and stirring is effected by radial currents created around the stirring impeller, it is possible to stir over a wide range from the bottom of the specimen liquid to the top in a short time. This effect appears markedly when the test tube is long and slender.

As a result of the tapered nozzle portion 29 being provided at the end of the pipe 24, even when the test tube has a tapered bottom it is possible for the stirring impeller 21 to be surely inserted deep into the bottom part of the test tube. Because the stirring impeller 21 is enclosed in the pipe 24 so that the gap between the stirring impeller 21 and the inner surface of the pipe 24 can be kept at a preset distance, the stirring impeller 21 never makes contact with the inner surface of the test tube 31 when the stirring impeller 21 is rotated at the bottom of the specimen liquid. Consequently, it is easy to have the stirring impeller 21 as close as possible to the bottom of the test tube. As a result, efficient stirring is possible irrespective of the shape of the inner surface of the test tube.

When stirring of the specimen liquid by the specimen stirring part 15 in the test tube 31 has been carried out for a predetermined period, the motor 23 is stopped. The raising and lowering means 14 then raises the arm 13. When the pipe 24 has returned to its initial position, the operation of the raising and lowering means 14 is stopped. Next, the sampler 16 is driven and the rack 32 is moved by 1 unit in the direction of the arrow in FIG. 2. As a result, the suction nozzle 33 is positioned directly above the test tube 31 containing specimen liquid which has just been stirred by the specimen stirring part 15. The raising and lowering means 14 then operates and lowers the suction nozzle 33. When the end of the suction nozzle 33 has entered the specimen liquid, the operation of the raising and lowering means 14 is stopped.

Next, in the specimen suction part 17, the motor 51 is driven and the specimen supply syringe 34 starts a sucking operation. At this time, the valves are in initial states. That is, the valves 39, 41, 43, 45 and 48 are closed and the sampling valve 37 is in an initial state wherein the fixed port A is connected to the movable port D, the fixed port B is connected to the movable port F and the specimen supply syringe 34 is consequently connected to the suction nozzle 33. After the specimen supply syringe 34 has sucked in a predetermined quantity of specimen liquid, the sampling valve 37 rotates so that the ports A and E are connected and the ports B and C are connected and the specimen supply syringe 34 delivers a fixed quantity of diluting liquid. At this time, a quantity of specimen liquid measured out between A and B is injected into the reaction tank 40 together with the diluting liquid.

When a predetermined quantity of specimen liquid has been fed into the reaction tank 40, the valve 45 is opened and the motor 53 is driven and the dye supply syringe 44 starts a sucking operation. When a predetermined quantity of dye liquid has entered the dye supply syringe 44, the valve 45 is closed, the valve 48 is opened, the motor 53 is driven and the dye supply syringe 44 starts a discharge operation. When dye liquid has thus been injected into the reaction tank 40 and uniformly mixed with the specimen liquid, this specimen liquid is transferred to the measuring system 47 and for example the contained quantities and shapes of solid components are measured by a photographic process. By a prescribed valve-switching operation it is possible to drive the diluting liquid supply syringe 35 and inject diluting liquid from the diluting liquid tank 42 into the specimen liquid in the reaction tank 40 and thereby freely dilute the specimen liquid.

The inside of the pipe leading from the suction nozzle 33 to the specimen supply syringe 34 is cleaned with cleaning liquid from the cleaning liquid tank 36. This cleaning is carried out with the valves in cleaning setting states. That is, cleaning is carried out with the valve 39 opened and with the sampling valve 37 in a state wherein the fixed port A is connected to the movable port D and the specimen supply syringe 34 is connected to the suction nozzle 33.

First, the raising and lowering means 14 raises the arm 13. When the specimen stirring part 15 has returned to its initial position the operation of the raising and lowering means 14 is stopped. Then, based on instructions from the control part, a positive pressure source 38 is driven for a predetermined time. This causes a predetermined quantity of cleaning liquid from the cleaning liquid tank 36 to pass through the sampling valve 37 and the suction nozzle 33 and be discharged into the test tube 31 from which specimen liquid has been taken, whereupon cleaning is finished.

In the preferred embodiment described above, when the specimen stirring part 15 is inserted into the test tube 31 and the rotating shaft 22 is rotated, specimen liquid is discharged downward through the nozzle portion 29 in a jet and a circulating flow of specimen liquid passing from outside the pipe 24 through the side holes 30 and back into the pipe 24 is formed. The specimen liquid discharged through the nozzle portion 29 in a jet flushes sediment at the bottom of the test tube 31 upward outside the pipe 24. Some of the flushed sediment is carried up to the side holes 30 by the specimen liquid circulating flow and circulates down the inside of the pipe 24. Therefore, compared to a conventional stirring device wherein a rotating shaft having a stirring impeller is rotated and radial currents are created around the stirring impeller, a specimen liquid circulating flow over a wide range from the bottom of the specimen liquid to the top is created and it is possible to carry out uniform dispersion of the specimen liquid in a short time. This also means that dispersion of specimen liquid per unit time is carried out to a high level. As a result, because specimen liquid which has been dispersed and made homogeneous to a high level can be delivered to an analyzing apparatus, it is possible to increase the accuracy of an analysis of the specimen liquid. This effect appears markedly when the test tube is long and slender.

Also, even when the specimen container has a tapered bottom like the urine test tube 31 it is possible for the tapered nozzle portion 29 provided at the bottom of the pipe 24 to be inserted as far as the bottom of the test tube 31. Because the stirring impeller 21 is enclosed in the pipe 24 so that the gap inside the pipe 24 between the stirring impeller 21 and the inner surface of the pipe 24 can be kept at a preset distance, the stirring impeller 21 never makes contact with the inner surface of the test tube 31 when the stirring impeller 21 is brought close to the bottom of the test tube 31 rotated at the bottom of the specimen liquid. Consequently, the stirring impeller 21 and the test tube 31 do not damage each other. Also, the stirring sound of the stirring impeller 21 is quiet. Furthermore, if the speed at which the specimen liquid is discharged through the nozzle portion 29 is adjusted by controlling the speed of the stirring impeller 21, efficient stirring of specimen liquids in containers having differently shaped bottoms, specimen liquids having different viscosities and different quantities of specimen liquids is possible.

Because the specimen stirring part 15 described above can thus handle various types of container having differently shaped bottom and insides, the freedom of the stirring operation is increased.

Furthermore, if the nozzle portion is tapered, because specimen liquid can be discharged from the nozzle portion as a jet, even when particles of sediment are relatively large or when their specific gravities are large they can be easily flushed up outside the pipe and made to circulate together with the specimen liquid circulating flow. Also, the nozzle portion can be easily inserted into a container having a tapered bottom.

With a specimen stirring device according to a first aspect of the invention, because a specimen liquid circulating flow of specimen liquid circulating through the outflow opening to outside the pipe and through the inflow opening to inside the pipe is formed, it is possible to efficiently stir the specimen liquid irrespective of the shape of the inside of the specimen container. Also, because sediment tending to settle at the bottom of the specimen container is picked up by the specimen liquid circulating flow and dispersed throughout the container, uniform stirring is possible.

With a specimen sampling apparatus according to a second aspect of the invention, because stirring of a specimen liquid in a specimen container is carried out effectively by the specimen stirring device described above using a specimen liquid circulating flow, the specimen stirring part can send uniformly stirred specimen liquid to a measuring or analyzing apparatus or the like. As a result, it is possible to perform highly accurate measurement or analysis.

If a nozzle portion is provided at the end of the pipe it is possible to create a jet toward the bottom of the specimen container when the end of the pipe is made a specimen liquid outflow opening and the nozzle portion is made convergingly tapered or toward the inside of the pipe when the end of the pipe is made a specimen liquid inflow opening and the nozzle portion is made divergingly tapered. As a result, sediment can be dispersed by the jet and a strong specimen liquid circulating flow can be created inside the specimen container. Also, if a pipe not provided with a nozzle portion at the end thereof or a pipe having a partition plate shaped nozzle portion at the end thereof is used, it is possible to create specimen liquid circulating flows in both directions and the nozzle portion can be simplified.

If the stirring impeller is disposed between the side holes and the nozzle portion it is possible to create a specimen liquid circulating flow of specimen liquid circulating through the outflow opening to outside the pipe and through the inflow opening to inside the pipe.

If the nozzle portion is made convergingly tapered, because specimen liquid can be discharged through the nozzle portion as a jet with low pressure loss, even when particles of sediment are relatively large or when their specific gravities are large they can be easily flushed up outside the pipe and made to circulate together with the specimen liquid circulating flow. Also, the nozzle portion can be easily inserted into a container having a tapered bottom.

If the specimen container containing the specimen liquid is a urine test tube having an open top and a tapered bottom, when the above-mentioned nozzle portion is inserted into the tapered urine test tube and the rotating shaft is driven, specimen components having settled at the bottom of the urine test tube can be picked up and carried by the specimen liquid circulating flow and stirred uniformly.

In this invention, it is preferable that the blades of the stirring impeller be so disposed that when the rotating shaft is rotated forward, the end of the pipe becomes an outflow opening and the side holes become inflow openings. Because in this way the side holes serve as an intake part and a specimen liquid circulating flow of specimen liquid flowing from the nozzle portion to outside the pipe, through the side holes and back into the pipe can be created, sediment tending to settle at the bottom of the specimen container can be flushed up on the outside of the pipe. Flushed specimen liquid circulates with the specimen liquid circulating flow through the side holes and into the pipe. As a result, a specimen liquid circulating flow over a wide range from the bottom of the specimen liquid to the top is created and it is possible to effect uniform dispersion of the specimen liquid in a short time. This also means that dispersion of specimen liquid per unit time is carried out to a high level. As a result, compared to a conventional stirring apparatus relying solely on radial currents created around the stirring impeller, highly efficient stirring can be performed. This effect appears markedly when the test tube is long and slender. Also, because specimen liquid which has been dispersed and made homogeneous to a high level can be delivered to an analyzing apparatus, it is possible to increase the accuracy of an analysis of the specimen liquid.

Furthermore, since even if the stirring impeller is brought close to the bottom of the specimen container the stirring impeller never makes contact with the specimen container because the stirring impeller is enclosed in the pipe, damage to the stirring impeller and the specimen container caused by contact between the two is prevented. Also, the stirring noise of the stirring impeller is quiet. Furthermore, if the speed at which the specimen liquid is discharged or sucked in through the nozzle portion is adjusted by controlling the speed of the stirring impeller, specimen liquids in containers having differently shaped bottom and specimen liquids having different viscosities can be stirred efficiently. Also, stirring can be carried out in a short time even when the quantity of specimen liquid in a specimen container is large.

Because the stirring apparatus described above can thus handle various types of container having differently shaped bottoms or insides, the freedom of the stirring operation is increased. Also, because specimen liquid dispersed to a high level can be supplied to an analyzing apparatus, it is possible to increase the analysis efficiency. As a result, stirring can be carried out efficiently irrespective of the shape of the inside of the specimen container.

(Other Preferred Embodiment)

Figure 7:
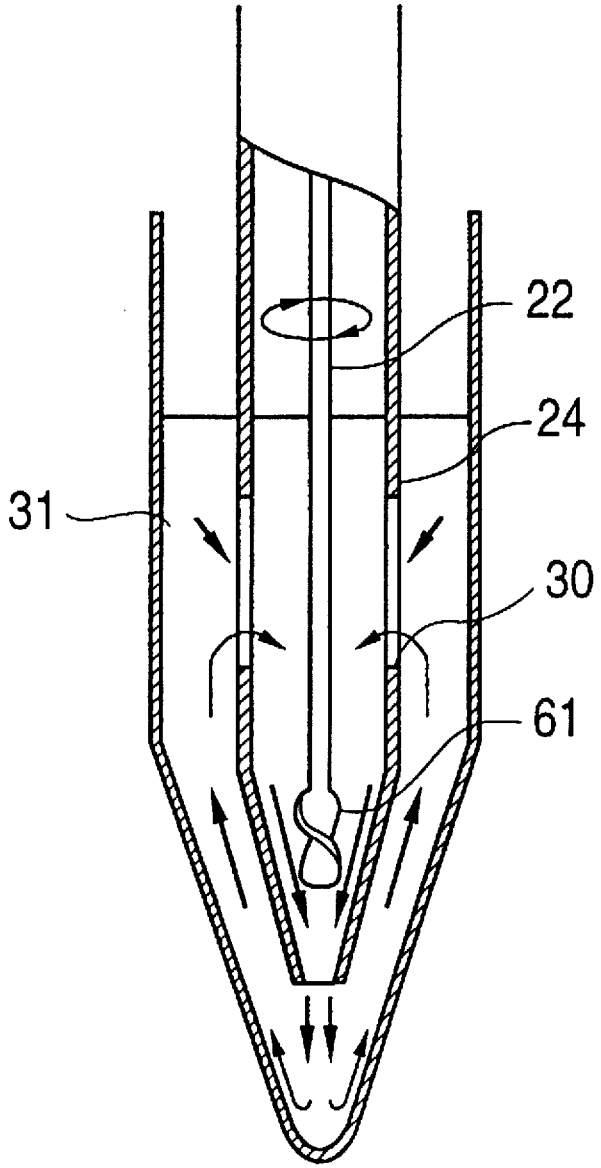
FIG. 7 is a view illustrating a specimen stirring device according to another preferred embodiment of the invention and the operation thereof.

In the preferred embodiment described above a propeller type stirring impeller 21 was used, but alternatively a helical (screw propeller type) stirring impeller 61, as illustrated in FIG. 7, consisting of a half strip extending axially may be used. In this case, the external dieter of the impeller can be made smaller and a predetermined discharge pressure can still be obtained. As a result, because the impeller can be brought closer to the nozzle portion 29, the discharge speed from the nozzle portion 29 can be increased and a stronger specimen liquid circulating flow can be created. The above-mentioned mentioned stirring impeller can be made a helical stirring impeller consisting of a single strip or a plurality of strips and extending further toward the base end of the rotating shaft.

What is claimed is:

1. A specimen stirring device for stirring a specimen liquid in a container, comprising:

a hollow pipe having at least one side opening at a side portion of said hollow pipe and at least one end opening at an end portion of said hollow pipe; and a stirring impeller rotatably disposed inside said hollow pipe, said stirring impeller creating a circulating flow of the specimen liquid circulating through one of said at least one side opening and said at least one end opening to the inside of said hollow pipe and through the other of said at least one side opening and at least one end opening to the outside of said hollow pipe, wherein blades of said stirring impeller are so disposed that when said impeller is rotated in one direction, said at least one end opening becomes an outflow opening and said at least one side opening becomes an in flow opening.

2. A specimen sampling apparatus, comprising:

a specimen stirring device which includes a hollow pipe having at least one side opening at a side portion of said hollow pipe and at least one end opening at an end portion of said hollow pipe, and a stirring impeller rotatably disposed inside said hollow pipe, said stirring impeller creating a circulating flow of the specimen liquid circulating through one of said at least one side opening and said at least one end opening to the inside of said hollow pipe and through the other of said at least one side opening and at least one end opening to the outside of said hollow pipe;

raising and lowering means for supporting and raising and lowering said specimen stirring device;

container moving means for moving said container in cooperation with the raising and lowering means; and a specimen suction part for sucking the specimen liquid stirred by the specimen stirring device from inside said container.

3. A specimen stirring device according to claim 1, wherein, said stirring impeller is positioned between said at least one side opening and said at least one end opening.

4. A specimen stirring device according to claim 1, wherein said at least one end opening includes a nozzle portion.

5. A specimen stirring device according to claim 4, wherein said nozzle portion is tapered.

6. A specimen stirring device according to claim 1, wherein said container containing the specimen liquid is a urine test tube having an open top and a tapered bottom.

7. A specimen stirring device according to claim 1, wherein said at least one side opening has a circular shape elongated in a longitudinal direction of said hollow pipe.

8. A specimen stirring device according to claim 6, wherein said at least one end opening discharges the specimen liquid toward said tapered bottom.

9. A specimen stirring device according to claim 1, wherein said at least one side opening includes at least two openings provided at said side of said hollow pipe and said at least one end opening includes a nozzle provided at a bottom end of said hollow pipe.

10. A specimen stirring device according to claim 1, wherein a shape of said hollow pipe is an approximation of a shape of said container.

11. A specimen stirring device according to claim 1, wherein said stirring impeller is connected to a shaft to rotate said stirring impeller by an external force.

* * * * *